US005195803A

United States Patent [19]

Quintile

[11] Patent Number: 5,195,803

[45] Date of Patent: Mar. 23, 1993

[54] RECLINING SEAT BACK ASSEMBLY FOR A WHEELCHAIR

[75] Inventor: Mark J. Quintile, Brunswick, Ohio

[73] Assignee: Invacare Corporation, Elyria, Ohio

[21] Appl. No.: 827,862

[22] Filed: Jan. 30, 1992

Related U.S. Application Data

[63] Continuation of Ser. No. 734,059, Jul. 22, 1991, abandoned, which is a continuation of Ser. No. 649,303, Jan. 30, 1991, abandoned, which is a continuation of Ser. No. 369,645, Jun. 21, 1989, abandoned.

[51] Int. Cl.[5] ..... A47C 1/026

[52] U.S. Cl. ..... 297/365; 297/353; 297/DIG. 4; 297/DIG. 10; 403/108; 403/109; 74/501.6; 74/501.5 R; 74/502

[58] Field of Search ..... 297/365, 353, DIG. 4, 297/DIG. 10; 79/501.5 R, 502.4, 509.6; 403/104, 108, 109, 328

[56] References Cited

U.S. PATENT DOCUMENTS

| | | | |
|---|---|---|---|
| 1,472,283 | 10/1923 | Smith | 403/108 X |
| 2,099,460 | 11/1937 | Bell | 297/365 |
| 2,218,319 | 10/1940 | Pfauser . | |
| 2,283,485 | 5/1942 | Beck . | |
| 2,562,143 | 7/1951 | Godfry et al. | 403/104 |
| 2,819,475 | 1/1958 | Ericsson . | |
| 2,833,336 | 5/1958 | McGregor | 297/365 |
| 2,834,402 | 5/1958 | Lauther et al. | 297/365 X |
| 3,042,449 | 7/1962 | Hutchinson et al. . | |
| 3,147,039 | 9/1964 | Smith et al. . | |
| 3,157,416 | 11/1964 | Sandbakken | 403/104 |
| 3,185,495 | 5/1965 | Pivacek . | |
| 3,191,990 | 6/1965 | Rugg et al. . | |
| 3,708,205 | 1/1973 | Rothermel . | |
| 3,881,773 | 5/1975 | Rodaway . | |
| 4,076,304 | 2/1978 | Deucher | 297/DIG. 10 |
| 4,119,342 | 10/1978 | Jones . | |
| 4,138,156 | 2/1979 | Bonner | 297/DIG. 10 |
| 4,193,147 | 3/1980 | Fischer | 297/DIG. 4 |
| 4,456,086 | 6/1984 | Wier et al. | 297/DIG. 10 |
| 4,487,453 | 12/1984 | Emmerich et al. . | |
| 4,564,973 | 1/1986 | Kordes | 403/104 X |
| 4,598,944 | 7/1986 | Meyer et al. | 297/DIG. 4 |
| 4,632,450 | 12/1986 | Holdt . | |
| 4,643,446 | 2/1987 | Murphy et al. | 297/DIG. 4 X |
| 4,691,962 | 9/1987 | Holdt . | |

FOREIGN PATENT DOCUMENTS

| | | |
|---|---|---|
| 660094 | 7/1929 | France . |
| 2048661 | 12/1980 | United Kingdom . |

OTHER PUBLICATIONS

P. L. Porter Company brochure entitled "Mechanical Locks," copyrighted 1977.

Bak, *Articulated Wheelchair Lifts Body and Spirit*, Design News, Jun. 19, 1989, at 116.

*Primary Examiner*—Peter A. Aschenbrenner

*Attorney, Agent, or Firm*—Fay, Sharpe, Beall, Fagan, Minnich & McKee

[57] ABSTRACT

A reclining seat back assembly for a wheelchair includes a frame member having a pair of side posts pivotally connected to the wheelchair chassis. Each side post has a rearwardly extending handle at its upper end. A pair of extendable struts each include a hollow outer strut member pivotally connected to the chassis and an inner strut member pivotally connected to one of the side posts and received in the outer strut member. The struts contract as the seat back is pivoted toward a reclined position and extend as the seat back is pivoted toward an upright position. Mounted on each outer strut member is a locking mechanism that includes an engaging member having a first engaging surface with a profile complementary to a second engaging surface on the lower end of the inner strut member. A spring biases each engaging member into engagement with its respective inner strut member. The engaging members are released from the inner strut members by actuating levers mounted on the side posts immediately beneath the handles. The actuating levers are connected to the engaging members by Bowden cable assemblies. In addition, the seat back is urged toward the upright position by a pair of spring-loaded link assemblies each having a lower end pivotally connected to the wheelchair chassis and an upper end pivotally connected to a lever arm extending from the lower end of a side post.

6 Claims, 5 Drawing Sheets

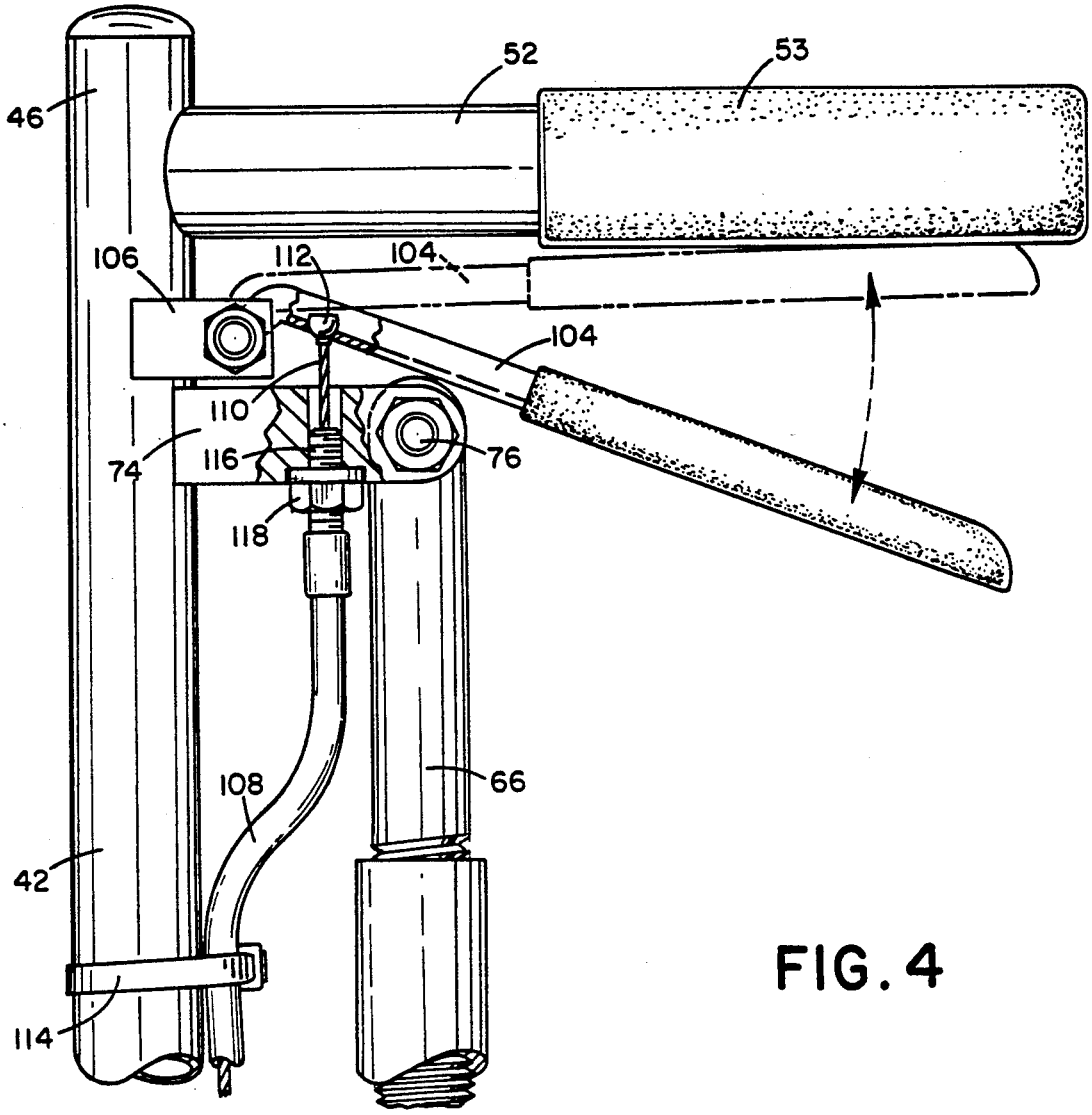
FIG. 4
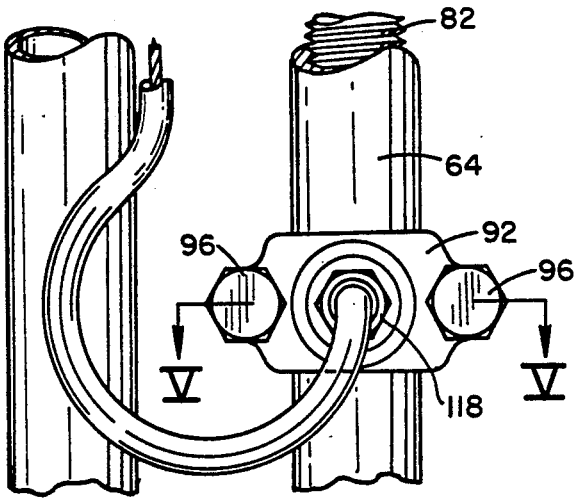

RECLINING SEAT BACK ASSEMBLY FOR A WHEELCHAIR

This is a continuation of copending application(s) Ser. No. 07/734,059 filed on Jul. 22, 1991, which in turn is a continuation of Ser. No. 07/649,303 filed on Jan. 30, 1991, now abandoned which in turn is a continuation of Ser. No. 07/369,646 filed on Jun. 21, 1989, now abandoned.

BACKGROUND OF THE INVENTION

1. Field of the Invention

The present invention relates to wheelchairs. In particular, the present invention relates to wheelchairs having reclinable seat backs.

2. Description of the Related Art

As is well known in the art, the comfort of a person using a wheelchair often can be enhanced by adjusting the angle of the wheelchair's seat back. Consequently, many arrangements have been proposed and employed to provide a wheelchair with a reclining seat back.

In a typical construction, the seat back panel is supported by a pair of side posts pivotally connected to the wheelchair chassis proximate the rear edge of the seat bottom. A telescoping strut is connected between the upper end of each side post and a point on the chassis. The struts elongate as the seat back is moved toward an upright position and contract as the seat back is reclined.

In one seat back arrangement presently in use, each strut comprises a tubular lower member pivotally connected to the chassis below and behind the seat bottom and a rod-shaped upper member pivotally connected to one of the side posts and received in the lower member. The handles for the wheelchair are fixed to the upper ends of the upper strut members, which are rotatable about the strut axes. The outer surface of the upper strut member received in the lower strut member has a longitudinally extending flat formed therein and includes threads formed over the remainder of its circumference. These threads mesh with a threaded engagement member brazed on the lower strut member to lock the seat back in a desired angular position relative to the seat bottom. When the wheelchair attendant rotates the handles outwardly, the threads of the upper members disengage from the engagement members of the lower members, and the attendant can elongate or contract the struts to adjust the inclination of the seat back.

Although the above-described reclining wheelchair design has met with commercial success, it can be unwieldy when the attendant attempts to adjust the position of the seat back while the wheelchair is occupied, particularly when occupied by a heavy patient. Releasing the engagement between the upper and lower strut members requires the attendant to support the weight of the patient during adjustment. When the attendant rotates the two handles outwardly to unlock the seat back, however, he or she typically exerts a downward force on the seat back just as it is released. Quick reflexes and considerable strength often are required to prevent the seat back from snapping to the reclined position while occupied.

The present invention is intended to provide a wheelchair with a reclining seat back that can be adjusted easily while the wheelchair is occupied.

The present invention also is intended to provide a reclining seat back with a release mechanism actuated in a manner that will naturally resist sudden downward movement of the seat back.

Additional advantages of the present invention will be set forth in part in the description that follows, and in part will be obvious from that description or can be learned by practice of the invention. The advantages of the invention can be realized and obtained by the apparatus particularly pointed out in the appended claims.

SUMMARY OF THE INVENTION

The present invention overcomes the problems of prior art reclining wheelchairs by providing a spring support mechanism that urges the seat back toward an upright position and by providing a Bowden cable release mechanism that can be operated by pulling up on actuating levers while gripping the wheelchair handles.

To overcome the problems of the prior art wheelchairs having reclining seat backs, and in accordance with the purpose of the invention, as embodied and broadly described herein, the reclining seat back assembly of this invention is for a wheelchair having a chassis supporting a generally horizontal seat bottom and comprises a frame member pivotable relative to the seat bottom through a range of angles, an extendable strut including a hollow outer strut member and an inner strut member, and means for releasably locking the frame member at a desired angle relative to the seat bottom. The frame member has a proximal end and a distal end, the proximal end being pivotally connected to the chassis proximate the seat bottom. The outer strut member has an open first end and a second end, and the inner strut member has a first end and a second end received within the outer strut member through the first end of the outer strut member. One of the second end of the outer strut member and the first end of the inner strut member is pivotally connected to the chassis. The other of the second end of the outer strut member and the first end of the inner strut member is pivotally connected to the frame member at the distal end thereof. The inner strut member slides relative to the outer strut member when the frame member is pivoted relative to the seat bottom. The inner strut member has adjacent the lower end thereof a first engaging surface with a toothed profile. The locking means includes an engaging member movably mounted on the outer strut member, and the engaging member includes a second engaging surface having a profile complementary to the first engaging surface of the inner strut member. The locking means also includes means for biasing the second engaging surface of the engaging member into engagement with the first engaging surface of the inner strut member to prevent movement of the inner strut member relative to the outer strut member. The locking means further includes actuating means mounted on the frame member at the distal end thereof and means for linking the actuating means to the engaging member so that movement of the actuating means moves the engaging member against the biasing means to disengage the first and second engaging surfaces and permit movement of the inner strut member relative to the outer strut member.

According to another aspect of the invention, the seat back assembly broadly comprises a frame member having a proximal end pivotally connected to the chassis proximate the seat bottom and a distal end, the frame member being pivotable relative to the seat bottom between an upright position and a reclined position, and means for urging the frame member to pivot toward the upright position. The urging means includes a lever arm fixed to the frame member at the proximal end thereof, an extendable link assembly including a first link member having a first end pivotally connected to the lever arm and a second link member having a second end pivotally connected to the chassis, and a spring connected between the first and second link members. The first and second link members move relative to each other along a common link axis as the frame member is pivoted relative to the seat bottom, with the distance between the first end of the first link member and the second end of the second link member decreasing as the frame member is pivoted toward the upright position and increasing as the frame member is pivoted toward the reclined position. The spring urges the first and second ends toward each other to urge the frame member toward the upright position.

The accompanying drawings, which are incorporated in and which constitute a part of this specification, illustrate at least one embodiment of the invention and, together with the description, explain the principles of the invention.

BRIEF DESCRIPTION OF THE DRAWINGS

FIG. 4 is a partially cut away elevational view of the locking means of the present invention;

DESCRIPTION OF THE PREFERRED EMBODIMENT

Reference now will be made in detail to the presently preferred embodiments of the invention, examples of which are illustrated in the accompanying drawings.

Figure 1:
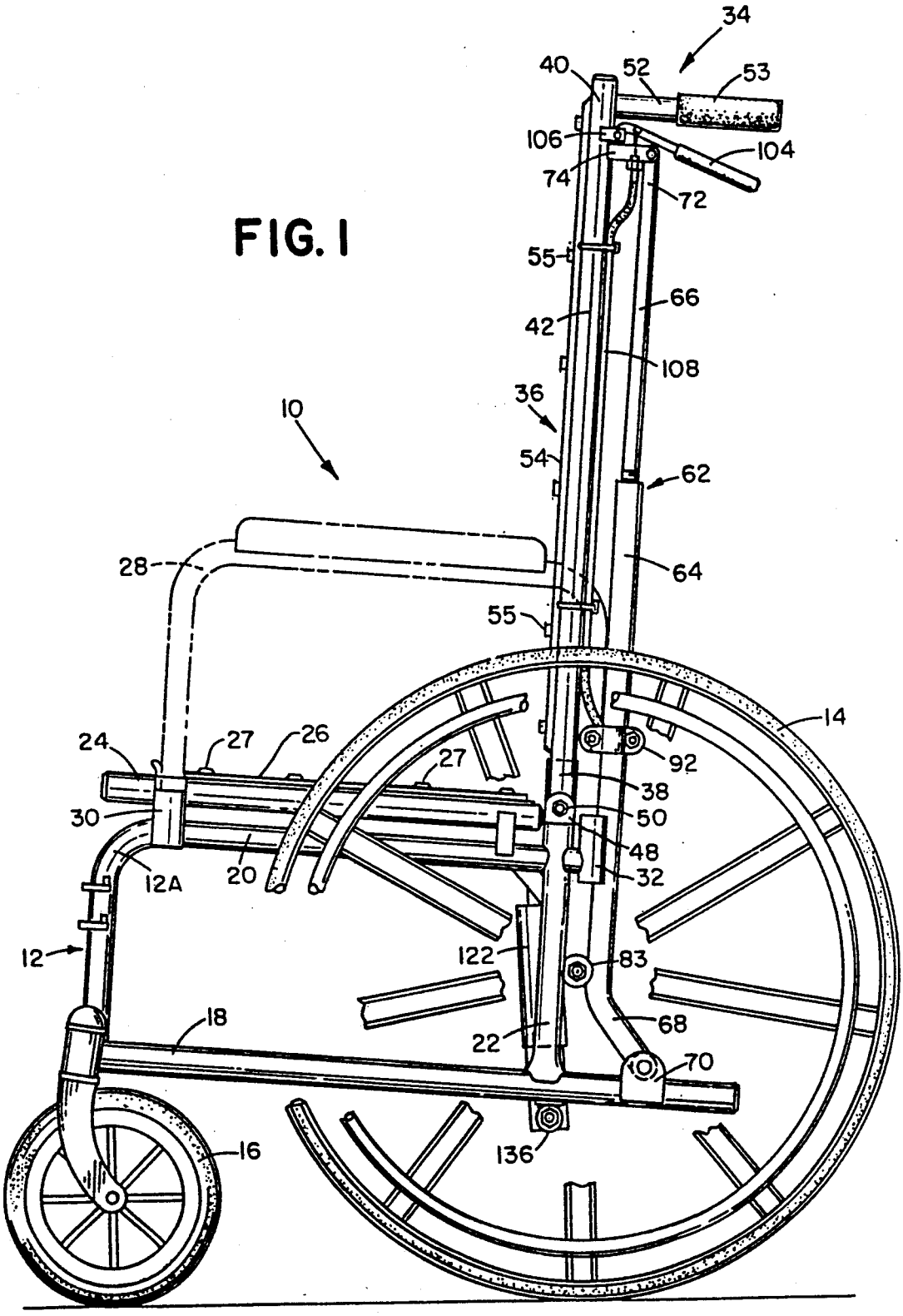
FIG. 1 is a partially cut away side elevational view of the left side of a wheelchair including the reclining seat back assembly of the present invention.
Figure 2:
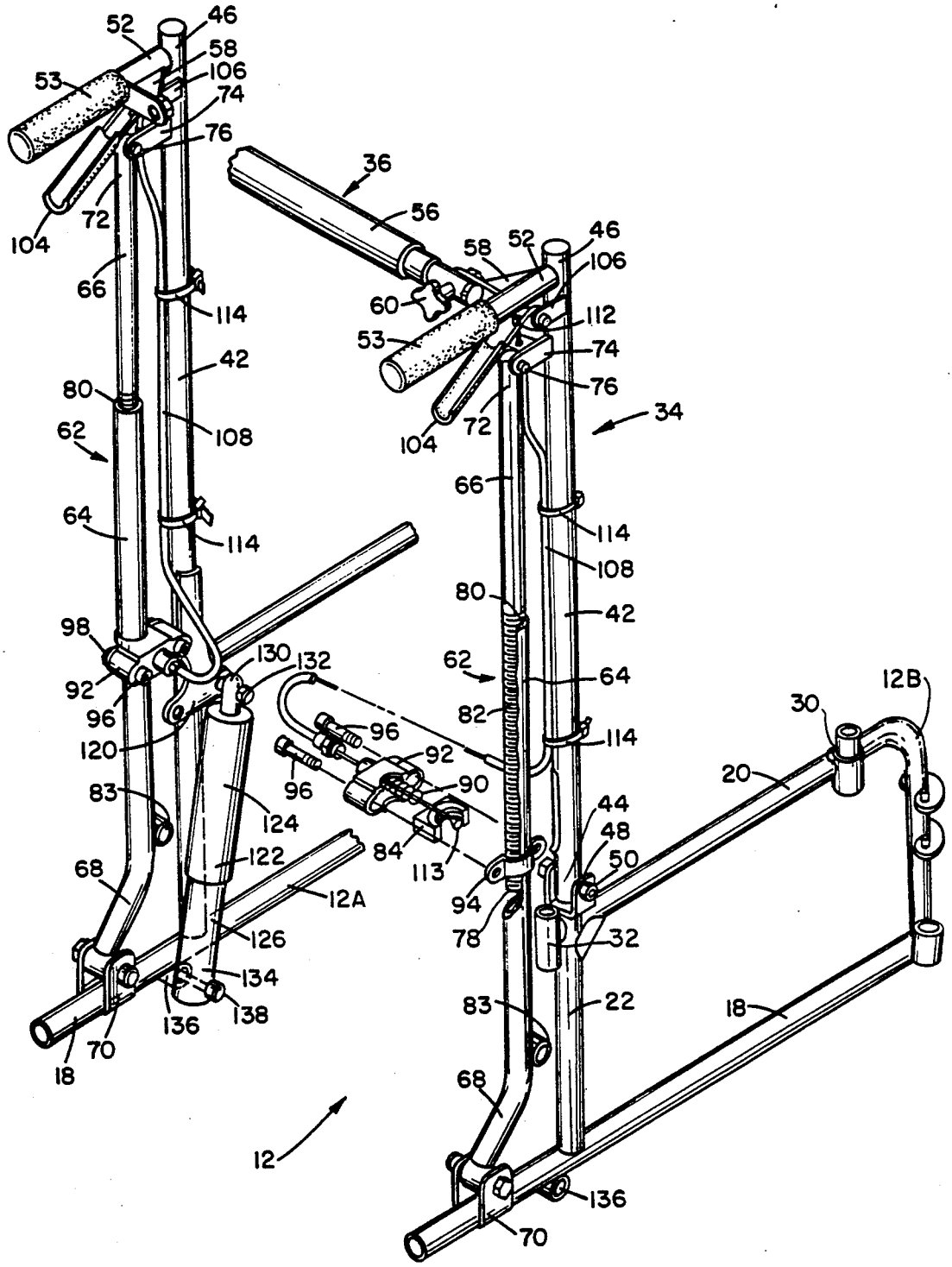
FIG. 2 is a partially cut away and exploded rear perspective view of a wheelchair chassis including the reclining seat back assembly of the present invention.

FIG. 1 is a side elevational view of a wheelchair, designated generally by reference numeral 10, that incorporates an embodiment of the reclining seat back assembly of the present invention. Wheelchair 10 includes chassis 12, which as shown in FIG. 2 includes left and right chassis halves 12A and 12B. Chassis halves 12A and 12B are connected in a parallel, spaced-apart relationship by a pair of cross braces (not shown). Wheelchair 10 is supported by a pair of driving wheels 14 and a pair of swivelable caster wheels 16. FIG. 1 shows only the left-side driving wheel 14 and caster wheel 16.

With continued reference to FIGS. 1 and 2, each chassis half 12A, 12B includes lower chassis bar 18, which is substantially horizontal, and L-shaped upper chassis bar 20. Chassis bars 18 and 20 are connected together by vertical connecting bar 22. Lower chassis bar 18, upper chassis bar 20, and connecting bar 22 preferably are connected by welding to provide rigid chassis halves 12A and 12B.

Wheelchair 10 further includes a pair of seat support bars 24, each of which is mounted on the horizontal portion of upper chassis bar 20 of one chassis half 12A, 12B. Only one seat support bar 24 is shown in FIG. 1. Wheelchair 10 also includes substantially horizontal seat bottom panel 26 connected between support bars 24. Seat bottom panel 26 preferably is connected to seat support bars 24 by threaded fasteners 27.

Wheelchair 10 also includes a pair of C-shaped armrests 28, one of which is shown with phantom lines in FIG. 1. Each chassis half 12A, 12B includes forward armrest socket 30 mounted on upper chassis bar 20 and rearward armrest socket 32 mounted on connecting bar 22. The ends of armrest 28 fit into and are supported by sockets 30 and 32.

Figure 3:
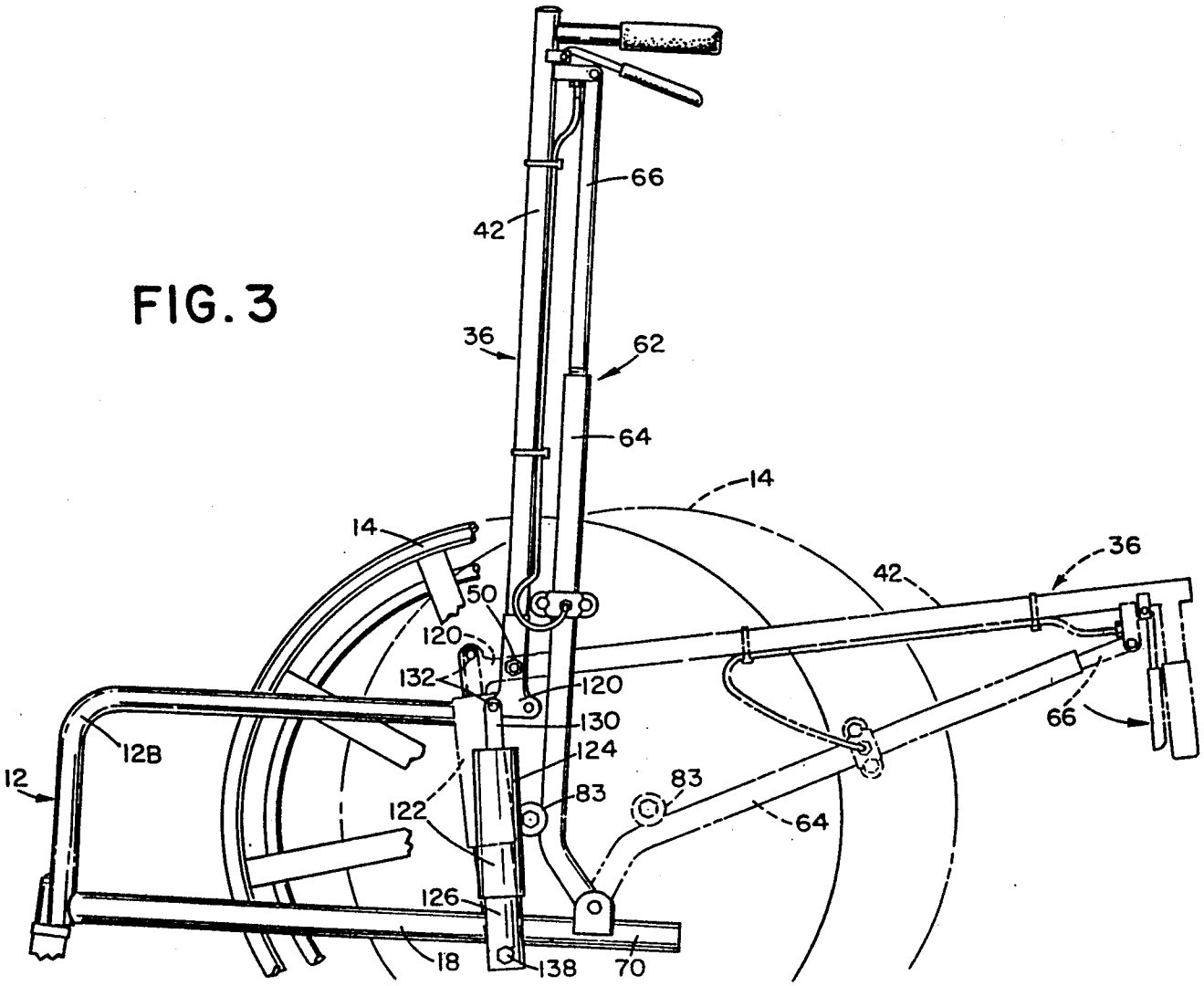
FIG. 3 is a partially cut away side elevational view of the lateral inside aspect of the right side of the wheelchair of FIG. 1, showing the seat back in both upright and reclined positions.
Figure 8:
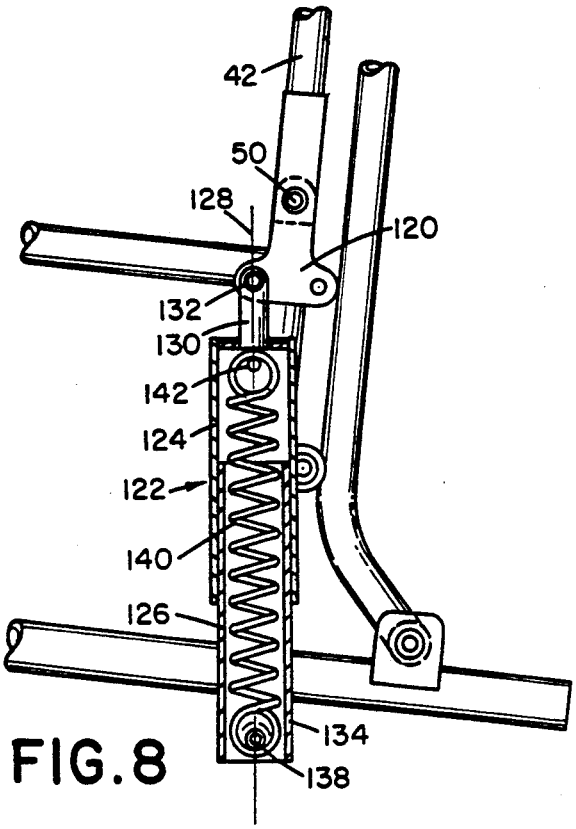
FIGS. 8 and 9 are partial cross-sectional views of two alternative embodiments of the means of the present invention for urging the frame member to pivot toward the upright position.

In accordance with the invention, wheelchair 10 is provided with a reclining seat back assembly, generally designated by reference numeral 34. The reclining seat back assembly of this invention includes frame member 36 having a proximal end 38 and a distal end 40. Proximal end 38 of frame member 36 is pivotally connected to chassis 12 proximate seat bottom panel 26. With reference to FIG. 3, which shows the inside-facing portion of the right side of wheelchair 10, frame member 36 is pivotable relative to the horizontal seat bottom through a range of angles, from an upright position shown with solid lines to a reclined position shown with phantom lines.

In accordance with the invention and as shown in FIG. 2, frame member 36 preferably includes a pair of parallel, spaced-apart side posts 42, each of which includes a proximal end 44 and a distal end 46. Each proximal end 44 is pivotally connected to upper clevis 48 mounted atop connecting bar 22 of its respective chassis half 12A, 12B. Each side post 42 pivots about pivot pin 50 passing through upper clevis 48 and proximal end 44. Frame member 36 also includes a handle 52 fixed to each side post 42 at distal end 46. A handgrip 53, preferably formed of resilient foam rubber, is fitted over each handle 52 to provide greater comfort for the wheelchair attendant. With reference to FIG. 1, seat back panel 54 is connected between side posts 42. Seat back panel 54 preferably is fastened to side posts 42 by threaded fasteners 55.

With reference to FIG. 2, wheelchair 10 preferably includes connecting bar 56 linking side posts 42 together. Each side post 42 includes connector bracket 58 proximate handle 52. Connector bar 56 is connected to connector brackets 58 by threaded knobs 60, only one of which is shown in FIG. 2.

In accordance with the invention, seat back assembly 34 includes at least one extendable strut 62 including a hollow outer strut member 64 and an inner strut member 66. The lower end of outer strut member 64 is pivotally connected to chassis 12, and the upper end of inner strut member 66 is pivotally connected to frame member 36 proximate distal end 40. As shown in FIG. 3, strut 62 contracts as frame member 36 is pivoted toward the reclined position and elongates as frame member 36 is pivoted toward the upright position.

As shown in FIG. 2, seat back assembly 34 preferably includes a pair of struts 62. Each outer strut member 64 has a lower end 68 pivotally connected to lower clevis 70 mounted on the rearward end of lower chassis bar 18. Lower end 68 preferably is angled rearwardly from the remaining portion of outer strut member 68. Upper end 7 of each inner strut member 66 is pivotally connected to distal end 46 of a side post 42. Specifically, each upper end 72 is pivotally connected to strut bracket 74 mounted on side post 42 via pin 76. Lower end 78 of inner strut member 66 is received within outer strut member 64 through the open upper end 80 of outer strut member 64. As shown with respect to right-side strut 62 in FIG. 2, each inner strut member 66 has adjacent its lower end 78 a first engaging surface 82 with a toothed profile. The toothed profile of first engaging surface 82 preferably comprises helical threads.

In accordance with the invention, each outer strut member 64 includes means for rotatably supporting a wheelchair driving wheel. As embodied herein, the wheel supporting means includes driving wheel bearings 83, one of which is fixed to each outer strut member 64 proximate its lower end 68, as shown in FIG. 1. Bearings 83 rotatably support driving wheels 14 on outer strut members 64. Consequently, as frame member 36 is pivoted toward its reclined position, as shown in FIG. 3, driving wheels 14 move rearwardly to provide more secure support for the patient sitting in wheelchair 10.

In accordance with the invention, reclining seat back assembly 34 includes means for releasably locking frame member 36 at a desired angle relative to the seat bottom. As embodied herein and as shown in FIGS. 2 and 4–7, the locking means of this invention includes engaging member 84 movably mounted on each outer strut member 64. Engaging member 84 includes second engaging surface 86 having a profile complementary to first engaging surface 82 of inner strut member 66. Engaging member 84 preferably is a half nut with second engaging surface 86 comprising helical threads that mate with first engaging surface 82. As will be apparent to those of ordinary skill in the art, however, first and second engaging surfaces 82 and 86 can comprise a variety of complementary profiles other than helical threaded profiles. Engaging member 84 is disposed within aperture 88 formed in the inwardly facing surface of each outer strut member 64 to permit engagement between engaging surfaces 82 and 86.

Figure 5:
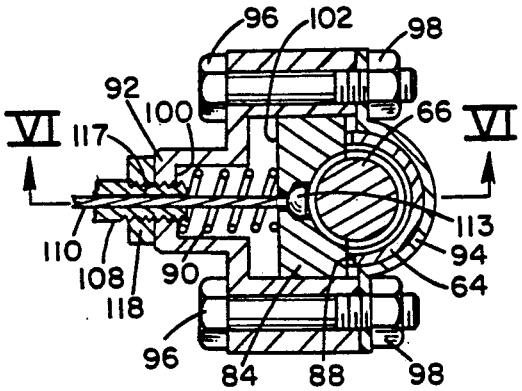
FIG. 5 is a cross-sectional view of the locking means of the present invention taken along line V—V of FIG. 4.
Figure 6:
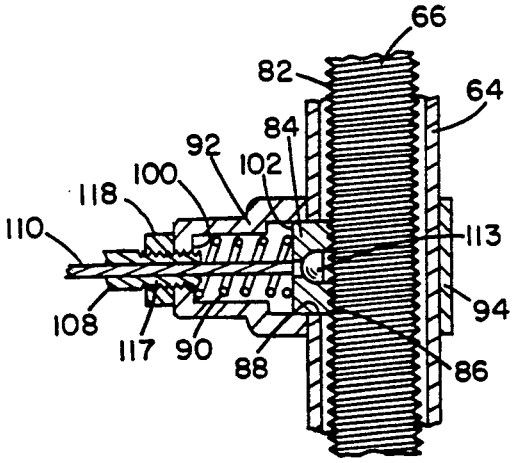
FIG. 6 is a cross-sectional view of the locking means of the present invention taken along line VI—VI of FIG. 5.

The locking means of the present invention also includes means for biasing second engaging surface 86 of each engaging member 84 into engagement with first engaging surface 82 of its respective inner strut member 66 to prevent movement of inner strut members 66 relative to outer strut members 64, thereby locking frame member 36 at a desired angle. As embodied herein, the biasing means of this invention includes a pair of coil springs 90, each of which is contained within a spring housing 92 mounted on each outer strut member 64 and covering aperture 88. Spring housing 92 is secured to outer strut member 64 by mounting strap 94, bolts 96, and nuts 98. As shown in FIGS. 5 and 6, coil spring 90 is disposed between spring seat 100 of spring housing 92 and spring face 102 of engaging member 84.

In accordance with the invention, the locking means of reclining seat back assembly 34 further includes a pair of actuating levers 104 pivotally mounted on frame member 36 at the distal end thereof. Specifically, each actuating lever 104 is pivotally connected to a lever bracket 106 fixed to distal end 46 of each side post 42 immediately beneath handle 52. The locking means of this invention also includes means for linking actuating lever 104 to engaging member 84 so that pivoting actuating lever 104 in a preselected direction moves engaging member 84 against the biasing means of coil spring 90 to disengage first and second engaging surfaces 82, 86 and permit movement of inner strut members 66 relative to outer strut members 64.

As embodied herein, the linking means of this invention includes a pair of Bowden cable assemblies 108. Each Bowden cable assembly 108 includes a sheathed wire 110 having engaging lugs 112 and 113 at its upper and lower ends, respectively. Each Bowden wire assembly 108 is connected to a respective side post 42 by straps 114. Engaging lug 112 at the upper end of each Bowden cable assembly is connected to actuating lever 104, and the lower engaging lug 113 is connected to engaging member 84. Actuating levers 104 and engaging members 84 are provided with slots to accommodate engaging lugs 112, 113. Bowden cable assembly 108 also includes upper and lower ferrules 116 and 117, which are threaded into strut bracket 74 and spring housing 92, respectively. Ferrules 116, 117 preferably are secured in place by nuts 118.

When actuator levers 104 are pivoted upwardly toward handles 52, as shown with phantom lines in FIG. 4, each engaging lug 112 is displaced upwardly, which causes lower engaging lug 113 and connected engaging member 84 to be displaced away from inner strut member 66 (to the left as seen in FIGS. 5 and 6), thereby disengaging second engaging surface 86 from first engaging surface 82. As a result, inner strut members 66 are released from the locking means and frame member 36 can be pivoted to the desired seat back angle. When actuating levers 104 are released, springs 90 force engaging members 84 back into engagement with inner strut members 66, thereby relocking frame member 36.

Although actuating levers 104 can be located in a number of positions, it is preferred to position them immediately beneath handles 52 and to orient the Bowden cable assembly so that upward pivoting of levers 104 disengages engaging member 84. In this preferred configuration, the wheelchair attendant imparts an upward force on the seat back assembly when disengaging the locking means. Consequently, the attendant is better able to support the weight of the released seat back, which is particularly important when the wheelchair is occupied by a patient.

To provide further assistance in supporting frame member 36 when the wheelchair is occupied, the reclining seat back assembly of this invention includes means for urging frame member 36 to pivot toward an upright position relative to the seat bottom. As embodied herein, the urging means of this invention includes a pair of lever arms 120, each of which is fixed to proximal end 44 of a side post 42. In the embodiments shown in the drawings, with specific reference to FIGS. 2, 3, 8, and 9, lever arm 120 is T-shaped, with its cross arm perpendicular to side post 42. Each lever arm 120 extends beyond pivot pin 50 of its respective side post.

The urging means of this invention also includes an extendable link assembly 122. In the embodiment shown in FIGS. 2, 3, and 8, link assembly 122 includes tubular first link member 124 and second tubular link member 126. Second link member 126 has a smaller diameter than first link member 124, is received within first link member 124, and can slide axially with respect to first link member 124 along a link axis 128. Affixed to the upper end of first link member 124 is connecting rod 130, which is pivotally connected to one end of the cross arm of lever arm 120 by pin 132. As shown in FIG. 2, lower end 134 of second link member 126 is pivotally connected to mounting lug 136 affixed to the underside of lower chassis bar 18 by pin 138. As shown in FIG. 3, first and second link members 124, 126 move relative to each other along link axis 128 as frame member 36 is pivoted between the upright position shown with solid lines and the reclined position shown with phantom lines. The distance between connecting bar 130 at the upper end of first link member 124 and lower end 134 of second link member 126 decreases as frame member 36 is pivoted toward the upright position and increases as frame member 36 is pivoted toward the reclined position.

In accordance with the invention, a spring is connected between first link member 124 and second link member 126 to urge contraction of link assembly 122 and urge frame member 36 toward the upright position. In the embodiment shown in FIG. 8, the spring comprises coil tension spring 140, which has one end connected to pin 138 at lower end 134 and a second end connected to pin 142 at the upper end of first link member 124.

Figure 9:
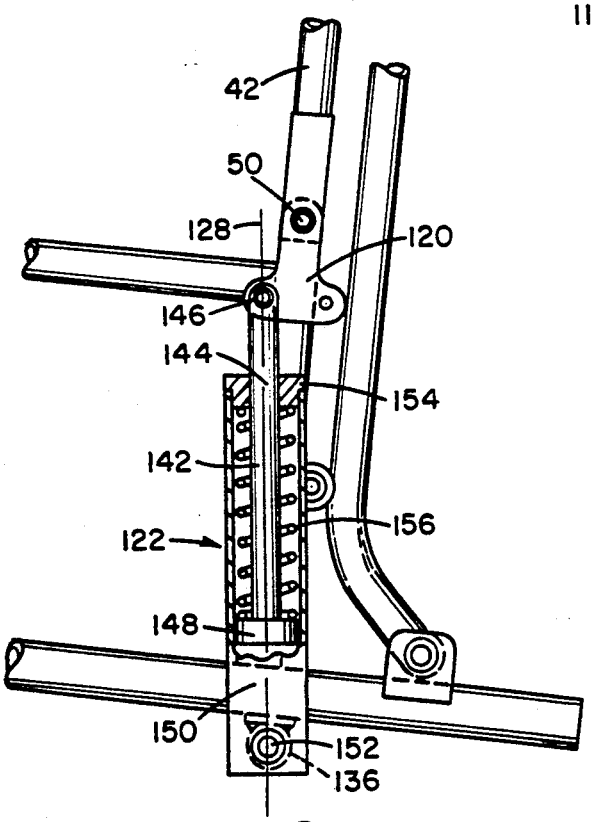
Figure 7:
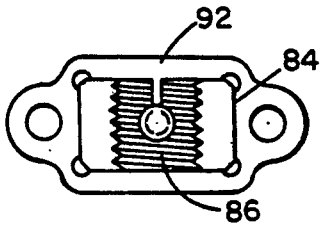
FIG. 7 is front view of the spring housing and engaging member of the locking means of the present invention.

In a second embodiment of the urging means of this invention, shown in FIG. 9, link assembly 122 includes first link member 142, which is comprised of piston rod 144 having is upper end pivotally connected to lever arm 120 by pin 146. Piston head 148 is fixed to the lower end of piston rod 144. First link member 142 is slidably received within tubular second link member 150, which is pivotally connected at its lower end to mounting lug 136 by pin 152. Surrounding piston rod 144 at the upper end of second link member 150 is stopper member 154, which serves as a spring support for compression coil spring 156, which spirals around piston rod 144 between stopper member 154 and the underside of piston head 148. Spring 156 urges piston head 148 toward the lower end of second link member 150, which in turn urges the seat back assembly toward the upright position.

In the embodiment shown in the drawings, lever arm 120 is substantially T-shaped and is connected to the upper end of link assembly 122 at a position spaced forwardly from a plane passing through side posts 42. The preferred shape shown in the drawings enables use of the same lever arm on either the right or left side posts. As will be apparent to one of ordinary skill in the art, L-shaped lever arms also can be used to achieve the same leverage effect as shown in the drawings. Alternatively, a straight lever arm can be used.

It will be apparent to those skilled in the art that other modifications and variations can be made in the apparatus of the invention without departing from the scope of the invention. For example, although the wheelchair shown in the drawings has paired struts, locking mechanisms, and link assemblies, a wheelchair can be provided with only one lockable strut or link assembly. In addition, the orientation of the struts can be reversed so that the outer strut members are connected to the distal ends of the side posts and the inner strut members are connected to the chassis. Linking means other than Bowden cables, for example, rod or bar links, can be used to link the actuating levers to the engaging members. Furthermore, devices other than coil springs, such as elastic bands or gas springs, can be used to operate the urging means. The invention in its broader aspects is, therefore, not limited to the specific details and illustrated examples shown and described. Accordingly, it is intended that the present invention cover such modifications and variations provided that they fall within the scope of the appended claims and their equivalents.

What is claimed is:

1. A reclining seat back assembly for a wheelchair having a chassis supporting a generally horizontal seat bottom, the seat back assembly comprising:

a. a frame member having a proximal end and a distal end, said proximal end being pivotally connected to the chassis proximate the seat bottom, said frame member being pivotable relative to the seat bottom through a range of angles between an upright position and a reclined position;

b. an extendable strut including a hollow outer strut member and an inner strut member, said outer strut member having an open first end and a second end, said inner strut member having a first end and a second end received within said outer strut member through said first end of said outer strut member, one of said second end of said outer strut member and said first end of said inner strut member being pivotally connected to the chassis, the other of said second end of said outer strut member and said first end of said inner strut member being pivotally connected to said frame member at said distal end thereof, said inner strut member sliding relative to said outer strut member when said frame member is pivoted relative to the seat bottom, said inner strut member having adjacent said second end thereof a first engaging surface with a toothed profile;

c. means for releasably locking said frame member at a desired angle relative to the seat bottom, said locking means including:

an engaging member movably mounted on said outer strut member, said engaging member including a second engaging surface having a profile complementary to said first engaging surface of said inner strut member, means for biasing said second engaging surface of said engaging member into engagement with said first engaging surface of said inner strut member to prevent movement of said inner strut member relative to said outer strut member, actuating means mounted on said frame member at said distal end thereof, and means for linking said actuating means to said engaging member so that movement of said actuating means moves said engaging member against said biasing means to disengage said first and second engaging surfaces and permit movement of said inner strut member relative to said outer strut member; and d. means for urging said frame member to pivot toward said upright position, said urging means including:

a lever arm fixed to said frame member at said proximal end thereof, an extendable link assembly including a first link member having a first end pivotally connected to said lever arm and a second link member having a second end pivotally connected to the chassis, said first and second link members moving relative to each other along a common link axis as said frame member is pivoted relative to the seat bottom, the distance between said first end of said first link member and said second end of said second link member decreasing as said frame member is pivoted toward said upright position and increasing as said frame member is pivoted toward said reclined position, and a spring connected between said first and second link members, said spring urging said first and second ends toward each other to urge said frame member toward said upright position.

2. The seat back assembly of claim 1, wherein said spring is a tension spring.

3. The seat back assembly of claim 1, wherein said spring is a compression spring.

4. The seat back assembly of claim 3, wherein:

said first link member includes a piston having a piston head opposite said first end along said link axis;

said second link member includes a cylinder having a spring support opposite said second end along said link axis; and said compression spring is a coil spring disposed along said link axis between said piston head of said piston and said spring support of said cylinder.

5. The seat back assembly of claim 1, wherein said common link axis is substantially vertical.

6. A reclining seat back assembly for a wheelchair having a chassis supporting a generally horizontal seat bottom, the seat back assembly comprising:

a. a frame member including a pair of substantially parallel side posts each having a proximal end and a distal end, said proximal ends being pivotally connected to the chassis proximate the seat bottom, said frame member being pivotable relative to the seat bottom through a range of angles, each of said side posts including a handle extending substantially orthogonally therefrom at said distal end thereof;

b. a pair of extendable struts each including a hollow outer strut member and an inner strut member, each of said outer strut members having an open first end and a second end pivotally connected to the chassis, each of said inner strut members having a first end pivotally connected to one of said side posts at said distal end thereof and a second end received within one of said outer strut members through said first end of said respective outer strut member, each of said inner strut members sliding relative to its respective outer strut member when said frame member is pivoted relative to the seat bottom, each of said inner strut members having adjacent said second end thereof a first engaging surface with a toothed profile;

c. means for releasably locking said frame member at a desired angle relative to the seat bottom, said locking means including:

a pair of engaging members each movably mounted on one of said outer strut members, each of said engaging members including a second engaging surface having a profile complementary to said first engaging surface of said inner strut member received in said respective outer strut member, means for biasing said second engaging surfaces of said engaging members into engagement with said first engaging surfaces of said inner strut members to prevent movement of said inner strut members relative to said outer strut members, a pair of actuating levers each pivotally mounted on one of said side posts adjacent said respective handle, and means for linking said actuating levers to said engaging members so that pivoting said actuating levers in a preselected direction moves said engaging members against said biasing means to disengage said first and second engaging surfaces and permit movement of said inner strut members relative to said outer strut members; and d. means for urging said frame member to pivot toward an upright position relative to the seat bottom, said urging means including:

a pair of lever arms each fixed to one of said side posts at said proximal end thereof, a pair of extendable link assemblies each including a first link member having a first end pivotally connected to said one of said lever arms and a second link member having a second end pivotally connected to the chassis, said first and second link members of each of said link assemblies moving relative to each other along a common link axis as said frame member is pivoted relative to the seat bottom, the distance between said first end of said first link member and said second end of said second link member for each of said link assemblies decreasing as said frame member is pivoted toward said upright position and increasing as said frame member is pivoted toward said reclined position, and a pair of coil springs each connected between said first and second link members of one of said link assemblies, said springs urging said first and second ends of each of said link assemblies toward each other to urge said frame member toward said upright position.

* * * * *